US008607723B2

(12) United States Patent
Voegler

(10) Patent No.: US 8,607,723 B2
(45) Date of Patent: Dec. 17, 2013

(54) WATER VEHICLE HAVING A PROFILED ELEMENT ARRANGED ON THE BOW SIDE

(76) Inventor: Ingo Voegler, Goa (IN)

( * ) Notice: Subject to any disclaimer, the term of this patent is extended or adjusted under 35 U.S.C. 154(b) by 0 days.

(21) Appl. No.: 13/564,039

(22) Filed: Aug. 1, 2012

(65) Prior Publication Data

US 2012/0304910 A1 Dec. 6, 2012

Related U.S. Application Data

(63) Continuation of application No. PCT/EP2010/000593, filed on Feb. 2, 2010.

(51) Int. Cl.
*B63H 9/04* (2006.01)

(52) U.S. Cl.
USPC ..... 114/102.29; 114/39.29; 114/126

(58) Field of Classification Search
USPC ..... 114/39.15, 39.21, 39.24, 39.28, 39.29, 114/102.12, 102.16, 102.29, 126, 273, 281
See application file for complete search history.

(56) References Cited

U.S. PATENT DOCUMENTS

| | | | | |
|---|---|---|---|---|
| 3,295,487 | A * | 1/1967 | Smith | 114/102.29 |
| 3,566,819 | A | 3/1971 | Keddie | |
| 6,668,741 | B1 | 12/2003 | Curtiss | |
| 6,789,489 | B1 | 9/2004 | Phipps | |
| 2006/0196403 | A1 | 9/2006 | Watts | |
| 2009/0205552 | A1 | 8/2009 | Urbanek | |

FOREIGN PATENT DOCUMENTS

| | | |
|---|---|---|
| BE | 1015726 | 7/2005 |
| DE | 3830820 | 3/1990 |
| DE | 19528796 | 2/1997 |
| DE | 102007008277 | 8/2008 |
| WO | 8702320 | 4/1987 |

OTHER PUBLICATIONS

International Search Report dated Dec. 13, 2010 for WO 2011/095178.

* cited by examiner

*Primary Examiner* — Lars A Olson
(74) *Attorney, Agent, or Firm* — Rankin, Hill & Clark LLP

(57) ABSTRACT

A device for arranging a profiled element on the bow side of a water vehicle and a water vehicle having a wind-impacted element. The device has at least one profiled element (40, 40.1, 40.2) and means for arranging the at least one profiled element (40, 40.1, 40.2) on the bow (20) of a water vehicle (10, 100), wherein the profiled element(s) (40, 40.1, 40.2) is/are or can be supported about a pivot axis (S) which is parallel, preferably horizontal, to the midship plane, wherein the profiled element(s) (40, 40.1, 40.2) can be or is/are connected to a wind-impacted element (14) at a leading point (43) of a wind-impacted-element-driven water vehicle (10, 100) by means of a connecting device (42), in particular by means of a whippletree (42).

13 Claims, 2 Drawing Sheets

WATER VEHICLE HAVING A PROFILED ELEMENT ARRANGED ON THE BOW SIDE

This application is a continuation of International Application No. PCT/EP2010/000593 filed on Feb. 2, 2010, which is currently pending and designates the United States.

BACKGROUND OF THE INVENTION

The invention relates to a device for arranging a profiled element on the bow side of a water vehicle and to a water vehicle having a wind-impacted element.

In the state of the art, daggerboards, swing centerboards and kickup keels or the like, which reduce the drift of the water vehicles, are known in wind-driven water vehicles. In the case of downwind courses of the water vehicles, e.g. sailboats, in which the drift is low or non-existent, it is possible to pull back the daggerboards, swing centerboards or kickup keels in order to reduce the flow resistance of the water vehicle or respectively to enable a draft of the water vehicle in a shallow body of water.

The named devices (daggerboards etc.) are designed for conventional sail drives and are hard to operate. The named devices are also constructively complicated and usually impair the usable volume of the water vehicle, since these devices are generally arranged centrally in the middle of the water vehicle.

Furthermore, it is known that in current wind-driven water vehicles a permanently arranged ballast keel is provided, in order to reduce the drift and to achieve an upending moment working against the heel moment. The weight of the ballast keel is hereby generally one-third to one-half of the total weight of the water vehicle whereby the usability or respectively the efficiency of the water vehicle is restricted accordingly and a higher draft also results.

Moreover, a method for low-drift or drift-free operation of a sailboat with a keel fin and a sail held outside the midship plane and accordingly adjustable into the wind is known from DE 195 28 796 A1.

Moreover, a device for receiving transverse forces in a ship with the drive systems for ships using wind is disclosed in DE 10 2007 008 277 A1.

Moreover, a water vehicle with a freely flying out, kite-like wind-impacted element as wind drive is known from EP 2 075 190 A1.

BRIEF SUMMARY OF THE INVENTION

Starting from this state of the art, the object of the invention exists in reducing a drift during the operation of the wind-impacted element in the case of wind-impacted-element-driven water vehicles.

This object is solved through a device for arranging a profiled element on the bow side of a water vehicle with at least one profiled element, with means for arranging the at least one profiled element on the bow of a water vehicle, wherein the profiled element(s) is/are or can be supported about a pivot axis which is parallel, preferably horizontal, to the midship plane, wherein the profiled element(s) can be or is/are connected to a wind-impacted element at a leading point by means of a connecting device, in particular by means of a whippletree, in such a way that the profiled element(s) can be or is/are pivoted depending on position of the leading point of the connecting device on the wind-impacted element loaded by the wind.

The invention is based on the idea that an apparatus or respectively device is provided through the bow-side arrangement of one or more profiled elements such that the tractive forces directed sideways of the predetermined or respectively desired travel direction of a wind-impacted-element-driven water vehicle are compensated based on, for example, a port or starboard side position of a wind-impacted element, in particular a kite, and correspondingly convert the requirements and the use in a forward drive for the water vehicle. For this, it is submerged on the port side into the water in the case of a port side position of the wind-impacted element and the leading point of the connecting device due to the pivotable profiled element connected with it, since the leading point of the connecting device is also automatically pivoted or submerged into the water on the port side through the traction direction and the tractive force of the bow-impacted element between the wind-impacted element and the profiled element of the profiled elements whereby a strong drift of the water vehicle is prevented.

During or after the submerging of the profiled element into the water, the water pressure also works against the submerged profiled element due to the drift of the water vehicle so that in the submerged state it automatically pivots into a position in which the moments generated by the tractive force of the kite and through the hydrodynamic uplift of the profiled element lift each other reciprocally, while only the forces directed in the travel direction are forwarded to the water vehicle. No heel moment is transferred to the water vehicle.

In the case of a starboard-side positioning of the wind-impacted element or respectively of the leading point for the connecting device of the profiled element on the wind-impacted element, the leading point is or will be also positioned on the starboard side so that the starboard-side profiled elements or the starboard-side part of the profiled element on the water vehicle is accordingly pivoted or respectively submerged into the water.

In the case of travel in the traction direction of the wind-impacted element, in particular the kite, i.e. in the case of downwind courses, the profiled element is preferably held above the water surface in the neutral position, whereby a potential flow resistance of the profiled element is or will be minimized.

In particular, the pivot axis of the profiled element is aligned horizontally in the midship plane wherein the profiled element(s) are designed hydrodynamically, respectively working against the traction effect of the wind-impacted element and generating uplift. Through the introduction of force via the connecting device between the wind-impacted element and the profiled element(s), the profiled elements are automatically turned in the corresponding position-dependent direction.

Moreover, it is provided in one embodiment that the profiled element(s) have a profile that is drop-like in cross-section, whereby a hydrodynamically optimized flow-line-shaped shape of the profiled element results.

Furthermore, it is advantageous in one embodiment that the profiled elements are pivotably mounted around a profiled-element longitudinal axis, wherein in particular the profiled-element longitudinal axis of the profiled element(s) is or will be designed in a neutral position transversely, in particular perpendicular to the midship plane.

Furthermore, it is preferred according to a further embodiment if a trimming device, in particular trim rope or the like, is provided such that the leading point of the connecting device on the wind-impacted element and on its tow rope or the like is or will be changed whereby the position of the leading point for the connecting device is or will be set between the profiled element and the leading point depending on a predetermined requirement. The balance of the water vehicle can hereby be changed. In the case of a sufficiently large whippletree and a boat shape opposite a rotation with relatively little resistance, the control of the water vehicle can even take place alone through control of the kite since the water vehicle remains at a fixed angle changeable via the trim rope to the traction direction of the kite. As a result, the operation of the water vehicle can take place in a very simple manner and can also be managed by a single person without aids, e.g. autopilots.

Moreover, the device for arranging a profiled element on the bow side of a water vehicle is further characterized in that the profiled element(s) on its longitudinal ends also has or have fin bodies, wherein in particular the fin bodies project laterally beyond the cross-sectional profile of the profiled element(s) in the end area.

It is hereby advantageous in one embodiment that the profiled element(s) are arranged in a, preferably horizontal, neutral position above the water and/or submerged under water in a pivoted, preferably non-horizontal, position at least partially.

Furthermore, the profiled element(s) are preferably mounted in a spring-loaded manner around their profiled-element longitudinal axis using at least one profiled-element spring device.

Moreover, the invention is characterized in that the uplift of the profiled elements can be set variably. For this, it is provided that the profiled element(s) each consist of several parts that can be turned against each other and components and is automatically set to the respectively optimal uplift.

Moreover, the object is solved through a water vehicle with a wind-impacted element and with at least one profiled element arranged on the bow of the water vehicle, wherein hereby a device described above for bow-side arrangement of a profiled element on a water vehicle is provided with at least one profiled element.

For this, it is preferred if the profiled element(s) in its or their neutral position is or are arranged symmetrically to the midship plane.

Within the framework of the invention, the profiled element can be one piece so that the profiled element is designed, for example, like a bearing surface. Moreover, it is possible within the framework of the invention that one profiled element is arranged on each of the port and starboard sides on the bow of the water vehicle, wherein in particular the two profiled elements are preferably interconnected. In particular, the profiled elements are arranged such that they are arranged in their neutral position, i.e. in particular in the case of the horizontal direction and in the non-pivot position, horizontally above the water or respectively the water line on the water vehicle.

Furthermore, a further embodiment of the water vehicle is characterized in that a control device is provided to control the position of the leading point of the connecting device on the wind-impacted element.

Furthermore, it is provided within the framework of the invention that a locking device is provided in order to lock, for example, the profiled element(s) in its or their neutral position in order to thereby enable travel in shallow waters or for facilitating the control or stabilization in fast downwind planing of the water vehicle.

Moreover, it is provided that the leading points of the connecting device, in particular whippletrees, of the profiled element(s), are adjustable preferably parallel to the longitudinal axis of the water vehicle, using a corresponding trim device for the connecting device, in order to set a predetermined balance of the profiled element(s).

Further characteristics of the invention will become apparent from the description of the embodiments according to the invention together with the claims and the included drawings. Embodiments according to the invention can fulfill individual characteristics or a combination of several characteristics.

BRIEF DESCRIPTION OF THE DRAWINGS

The invention is described below, without restricting the general intent of the invention, based on exemplary embodiments in reference to the drawings, whereby reference is expressly made to the drawings with regard to the disclosure of all details according to the invention that are not explained in greater detail in the text. They show in.

DETAILED DESCRIPTION OF THE INVENTION

In the following figures, the same or similar types of elements or respectively corresponding parts are provided with the same reference numbers in order to prevent the item from needing to be reintroduced.

Figure 1:
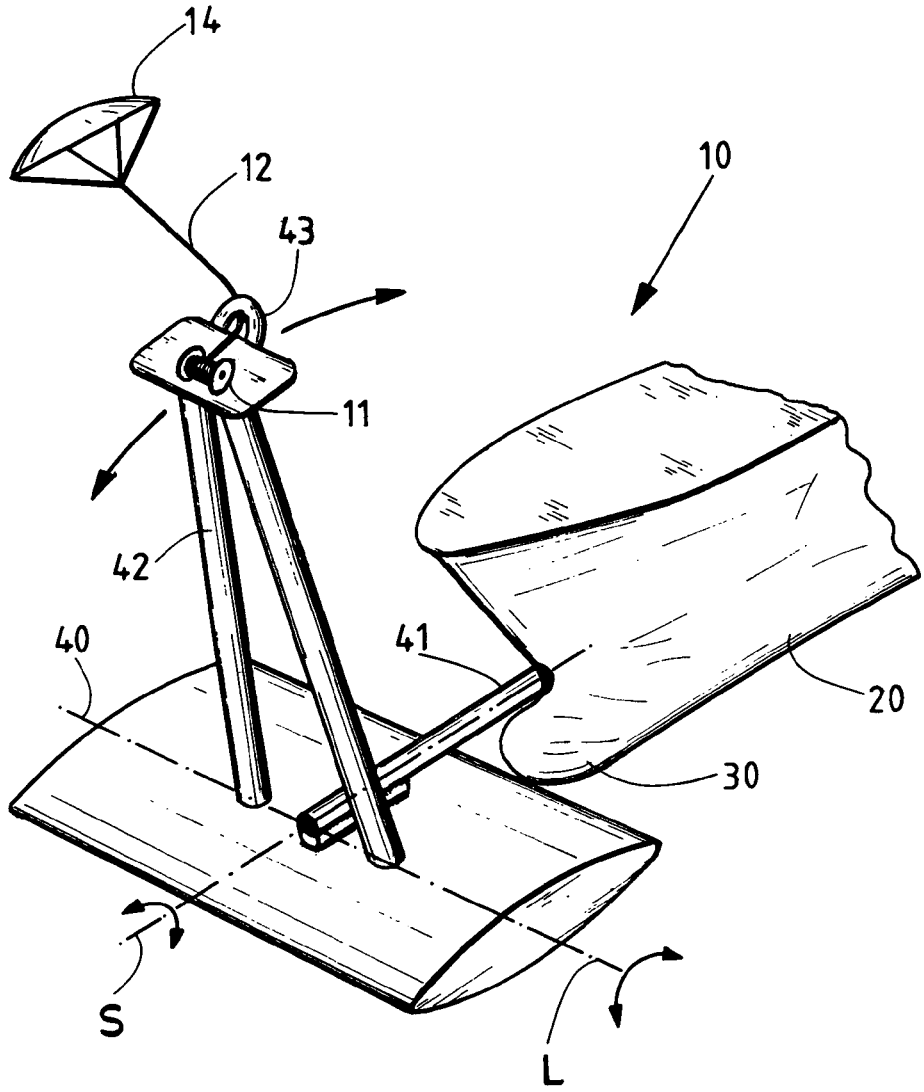
FIG. 1 schematically a perspective view of a bow area of a ship with a bow front end according to the invention and FIG. 2 schematically a perspective view of a boat with a further bow front end according to the invention.

FIG. 1 shows in a simplified schematic representation the bow area 20 of a ship 10, wherein the bow area 20 has a bulbous bow 30 on the bow-side. A bearing-surface-like profiled element 40 is arranged in front of the bow area 20 or respectively in front of the bulbous bow 30 via a rod-like connection 41, wherein the rod-like connection 41 is designed and connected with the bow area 20 such that the profiled element 40 is pivotable around a pivot axis S, wherein the pivot axis S is aligned horizontally in the midship plane of the ship 10.

Through the pivotability of the profiled element 40, which is shown in FIG. 1 in its neutral position, it is possible to submerge into the water or respectively pivot the profiled element 40 arranged above the water. Above the profiled element 40, a whippletree 42 is designed, which is connected with the profiled element 40 and is pivotably mounted around the longitudinal axis L of the profiled element 40.

The whippletree 42, itself, is connected on the side facing away from the profiled element 40 via a leading point 43 with a tow rope 12 of a kite system of the ship 10. A rope winch 11 of the kite system is hereby arranged on the whippletree 42, on which the tow rope 12 is or will be wound. A kite 14, preferably a stunt kite, is arranged on the end of the tow rope 12 as a wind-impacted element, which is designed, for example, in the form of a parachute or the like. Using the kite system, the motor-driven drive of the ship 10 is supported for correspondingly prevailing winds.

Due to the distance between the leading point 43 and the pivot axis S, a lever is designed, whereby the lever and the profiled element 40 are pivoted around the pivot axis S. If the leading point 43 of the whippletree 42 is located on the port side, then the port-side half of the profiled element 40 is submerged in the water. In the case of a positioning of the leading point 43 on the starboard side, the starboard-side half of the profiled element 40 is correspondingly automatically submerged on the starboard side.

By turning the profiled element 40 around the longitudinal axis L, the hydrodynamic uplift can be changed such that the portion lying perpendicular to the travel direction of the force transferred from the kite 14 via the whippletree 42 to the profiled element 40 is exactly compensated, and thus no drift occurs. Thus, force directed almost exclusively in the travel direction is transferred to the ship 10 via the connection 41.

The whippletree 42 simultaneously serves as the start and docking mast for the kite 14. In the case of travel without wind drive, the whippletree 42 including the folded up kite 14 rests on the bow area 20 of the ship 10.

Moreover, it is possible in another (not shown here) embodiment that further fins are attached laterally, preferably at a right angle, on the profiled element on the end-side outer surfaces in order to improve the efficiency level of the profiled element 40 during submersion into the water during travel of the ship.

Figure 2:
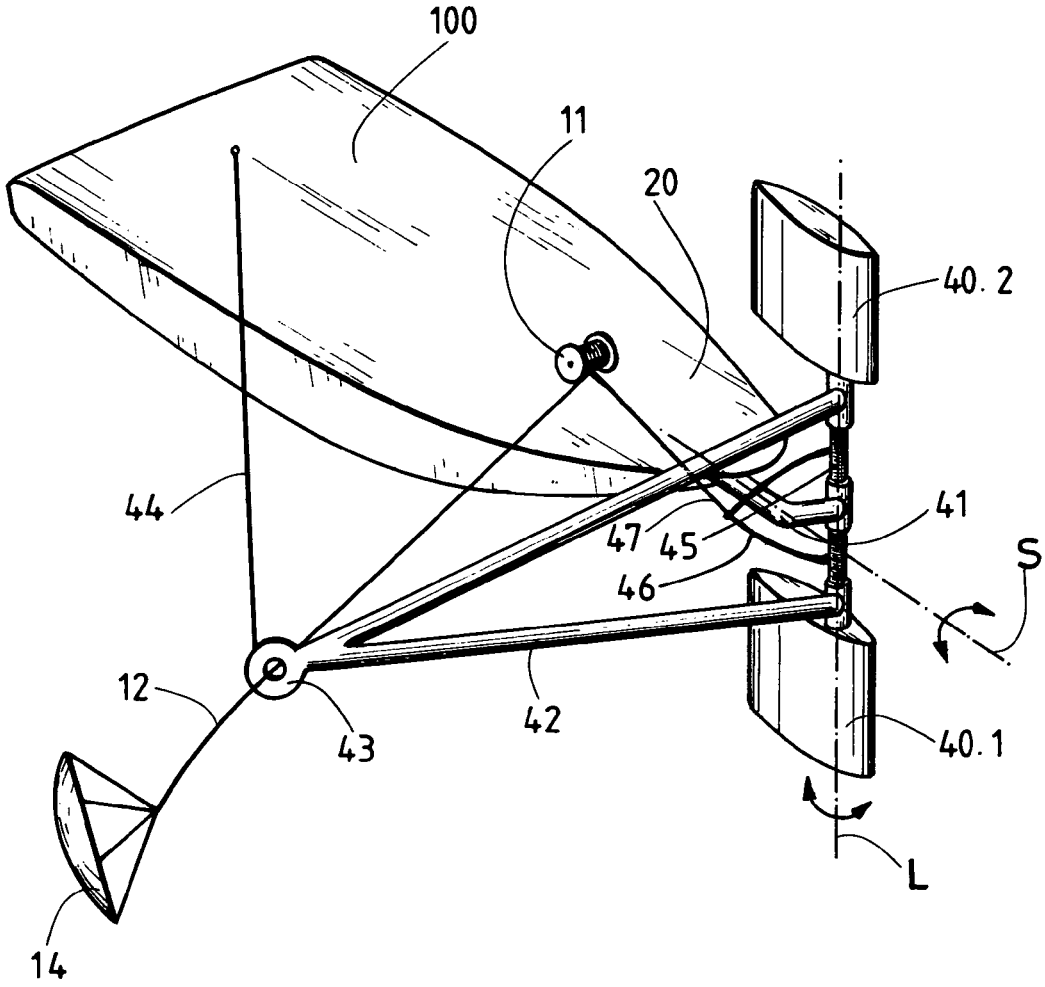

Moreover, it is also possible within the framework of the invention to arrange, instead of one profiled element, one profiled element on the port side and one on the starboard side, as is shown in FIG. 2, wherein the two profiled elements 40.1, 40.2 are interconnected and are connected by means of a corresponding rod or the like with the rod-like connection 41 for connection with the bow area 20 of the ship 10.

In the exemplary embodiment for a bow front end shown in FIG. 2, two spaced profile elements 40.1, 40.2 are arranged on the bow front side of the boat 100, wherein the profiled element 40.1 is arranged on the starboard-side and the profiled element 40.2 is arranged on the port side. The two drop-like profiled bodies 40.1, 40.2 are interconnected by means of a connecting device 45 in the form of a transverse support or the like. Furthermore, the rod-like connection 41 and the whippletree 42 are also connected with the two profiled elements 40.1, 40.2.

For adjustment of the leading point 43 on the tow rope 12, the stern section of the boat 10 is connected with the whippletree 42 via a trim rope 44 in order to adjust, accordingly, a preferred and predetermined leading point 43 for the whippletree 42.

Through a shortening or lengthening of the trim rope 44 on the whippletree 42, it is possible due to the set leading point, to compensate accordingly the tractive force of the kite 14 into a forward drive or reverse drive for braking the boat 100 or the tractive force in a neutral position or park position of the whippletree 42.

Since the leading point 43 in the case of the given length of the trim rope 42 remains in a fixed position relative to the boat 100 and forms a large lever around the lateral center of gravity lying in the midship plane, the boat 100 can be controlled through direction change of the kite.

Moreover, the longitudinal axis L of the profiled elements 40.1, 40.2 is drawn in FIG. 2, wherein it is possible that the profiled elements 40.1, 40.2 are moved around the longitudinal axis L using a lever 46 and a connecting rod 47, whereby for example the maneuverability of the boat 100 is further increased.

Moreover, it is possible in a further embodiment that the profiled elements 40.1, 40.2 are spring-mounted, preferably around their longitudinal axis L, wherein the greatly fluctuating tractive forces of the kite 14 can hereby be compensated using a suspension.

All named characteristics, including those taken from the drawing alone, and individual characteristics, which are disclosed in combination with other characteristics, are considered alone and in combination as important to the invention. Embodiments according to the invention can be fulfilled through individual characteristics or a combination of several characteristics.

LIST OF REFERENCES

10 Ship
11 Winch
12 Tow rope
14 Kite
20 Bow area
30 Bulbous bow
40, 40.1, 40.2 Profiled element
41 Connection
42 Whippletree
43 Leading point
44 Trim rope
45 Connecting device
46 Lever
47 Connecting rod
100 Boat
S Pivot axis
L Longitudinal axis

The invention claimed is:

1. A device for arranging a profiled element (40) on a water vehicle (10, 100), comprising:

at least one profiled element (40, 40.1, 40.2), and means for arranging the at least one profiled element (40, 40.1, 40.2) on the bow (20) of a water vehicle (10, 100), wherein the profiled element(s) (40, 40.1, 40.2) is/are supported about a pivot axis (S) which is parallel to a midship plane, wherein the profiled element(s) (40, 40.1, 40.2) is/are connected to a wind-impacted element (14) at a leading point (43) of a wind-impacted-element-driven water vehicle (10, 100) by means of a connecting device (42) in such a way that the profiled element(s) (40, 40.1, 40.2) are pivoted or pivotable depending on the position of the leading point (43) of the connecting device (42) on the wind-impacted (14) element loaded by wind, wherein a trim device (44) is provided such that the leading point (43) of the connecting device is changeable or is changed, wherein the profiled elements (40, 40.1, 40.2) are arranged in a neutral position above the water or at least partially submerged under water in a pivoted position, and wherein the connecting device (42) is a whippletree (42).

2. The device according to claim 1, wherein the profiled element(s) (40, 40.1, 40.2) has/have a drop-shaped profile in cross-section.

3. The device according to claim 1, wherein the profiled element(s) (40, 40.1, 40.2) is/are pivotably mounted around a profiled-element longitudinal axis (L).

4. The device according to claim 3, wherein the profiled-element longitudinal axis (L) of the profiled element (40, 40.1, 40.2) is/are designed in a neutral position diagonally or perpendicular to the midship plane.

5. The device according to claim 1, wherein the trim device (44) is a trim rope (44).

6. The device according to claim 1, wherein the profiled element(s) (40, 40.1, 40.2) has or have fin bodies on its longitudinal ends.

7. The device according to claim 6, wherein the fin bodies project laterally beyond the cross-sectional profile of the profiled element(s) (40, 40.1, 40.2) at said longitudinal ends.

8. The device according to claim 1, wherein the profiled elements (40, 40.1, 40.2) are arranged in a horizontal neutral position above the water and/or at least partially sub-merged under water in a pivoted non-horizontal position.

9. The device according to claim 1, wherein the profiled elements (40, 40.1, 40.2) are spring-mounted around their profiled-element longitudinal axis (L).

10. The device according to claim 1, wherein the uplift of the profiled elements (40, 40.1, 40.2) can be set variably.

11. A water vehicle (10, 100) with a wind-impacted element and with at least one profiled element (40, 40.1, 40.2) arranged on the bow (20) of the water vehicle (10, 100), wherein a device is provided according to claim 1.

12. The water vehicle (10, 100) according to claim 11, wherein the profiled bodies (40, 40.1, 40.2) is or are arranged in its or in their neutral position symmetrical to the midship plane.

13. The water vehicle (10, 100) according to claim 12, wherein a control device for controlling the position of the leading point of the connecting device is provided on the wind-impacted element.

* * * * *